United States Patent [19]

Breitenstein

[11] 4,107,882

[45] Aug. 22, 1978

[54] DRILL PRE-POINTING MACHINE

[75] Inventor: Charles Thomas Breitenstein, Elk Grove Village, Ill.

[73] Assignee: Spiral Step Tool Company, Elk Grove Village, Ill.

[21] Appl. No.: 794,671

[22] Filed: May 6, 1977

[51] Int. Cl.[2] ..... B24B 3/26

[52] U.S. Cl. ..... 51/118; 51/215 CP; 51/219 R

[58] Field of Search ..... 51/42, 89, 105 R, 105 SP, 51/118, 131, 215 CP, 215 H, 219 R, 237 R

[56] References Cited

U.S. PATENT DOCUMENTS

| | | | |
|---|---|---|---|
| 407,721 | 7/1889 | Cox | 51/42 |
| 1,856,185 | 5/1932 | Guild | 51/42 |
| 1,926,577 | 9/1933 | Behle | 51/89 |
| 2,477,730 | 8/1949 | Fouquet | 51/215 H |
| 2,814,168 | 11/1957 | Wells | 51/89 |
| 2,897,635 | 8/1959 | Stephanoff | 51/89 X |
| 3,711,997 | 1/1973 | Kushigian | 51/215 H |

FOREIGN PATENT DOCUMENTS

| | | | |
|---|---|---|---|
| 432,504 | 7/1935 | United Kingdom | 51/89 |

*Primary Examiner*—Nicholas P. Godici
*Attorney, Agent, or Firm*—Callard Livingston

[57] ABSTRACT

A grinding machine with a high production rate for pre-pointing drill bodies and the like in automatic duty cycles wherein separate grinding heads and a chuck head are respectively shiftable to and from a working position to grind both ends of the drill body simultaneously. The chuck head includes a special through-feeding rotary chuck which is journalled at its periphery and through which the work pieces are loaded and unloaded sequentially and unidirectionally by a fast-acting loading plunger advancing rapidly in an initial portion of its loading stroke, with completion at a slowed rate for accurate lodgement of the drill bodies with both ends precisely positioned for engagement by the grinding wheels.

16 Claims, 8 Drawing Figures

DRILL PRE-POINTING MACHINE

In accordance with the invention, the pre-pointing machine affords an increased production rate resulting from the coaction of a rotary chuck means with feed-through collet mounted on a transfer slide and working in conjunction with individually shiftable slide-mounted grinding heads, all reciprocable to and from a working position in which the chuck exposes both ends of the work piece from said collet to simultaneous abrading action by grinding wheels carried by said grinding heads each effecting a presettable forming cut on one of said ends, together with means operative to feed drill bodies unidirectionally into and out of said collet.

In accordance with another aspect of the invention, the output rate of the machine is further increased in that the means for feeding the blank drill bodies includes a magazine therefor aligned with a home position of the chuck head, a loading ram reciprocable relative to the magazine and operative to accept the drill bodies therefrom one at a time and advance the same into the chuck collet at said home position, together with fluid-activated means for advancing the ram rapidly from a home position to a threshold position, and from the latter position to complete the loading stroke at a slower rate whereby the blank is accurately entered into the collet with the ends thereof exposed in predetermined location for engagement respectively with one of the grinding wheels.

In accordance with still another feature of the invention, the through-feeding chuck means is of a split construction comprising an assembly of two relatively shiftable annular body sections, a first one of which is journalled in a carrier plate solely by supporting engagement with anti-friction rollers engaging a peripheral aspect thereof, and the second of which is supported slideably by the first section for axially-shifting displacement relative thereto to effect opening and closing of the chuck collet, such shifting action being effected by a circumambient ring cam and wedging roller means displaced thereby against peripheral portions of the second section out of a normal position in relation to the first section, together with collet means having a through-bore carried by one section and collet actuating means carried by the other section and operative to cause the collet to open in the shifted position of the second member, and spring means urging the second section into the normal position.

According to yet another feature, programmed control means is provided for actuating the machine in a step-by-step mode responsive to operation of individual step switches, and in an automatic mode responsive to an "Auto" cycling switch, and connections with preset program switches and supervisory limit switches actuated by the loading ram, and the chuck and grinding heads, in certain home and forward positions relative to the working position, whereby the movements of the loading ram, chuck head, grinding heads, chuck motor and a chuck-actuating fluid drive means are effected in a predetermined order in sequential steps repetitiously in the automatic mode and in selected steps in the manual mode.

Additional aspects of novelty and utility will appear from the following detailed description of the construction and operation of the apparatus by way of example, taken in view of the annexed drawings in which.

Figure 1:
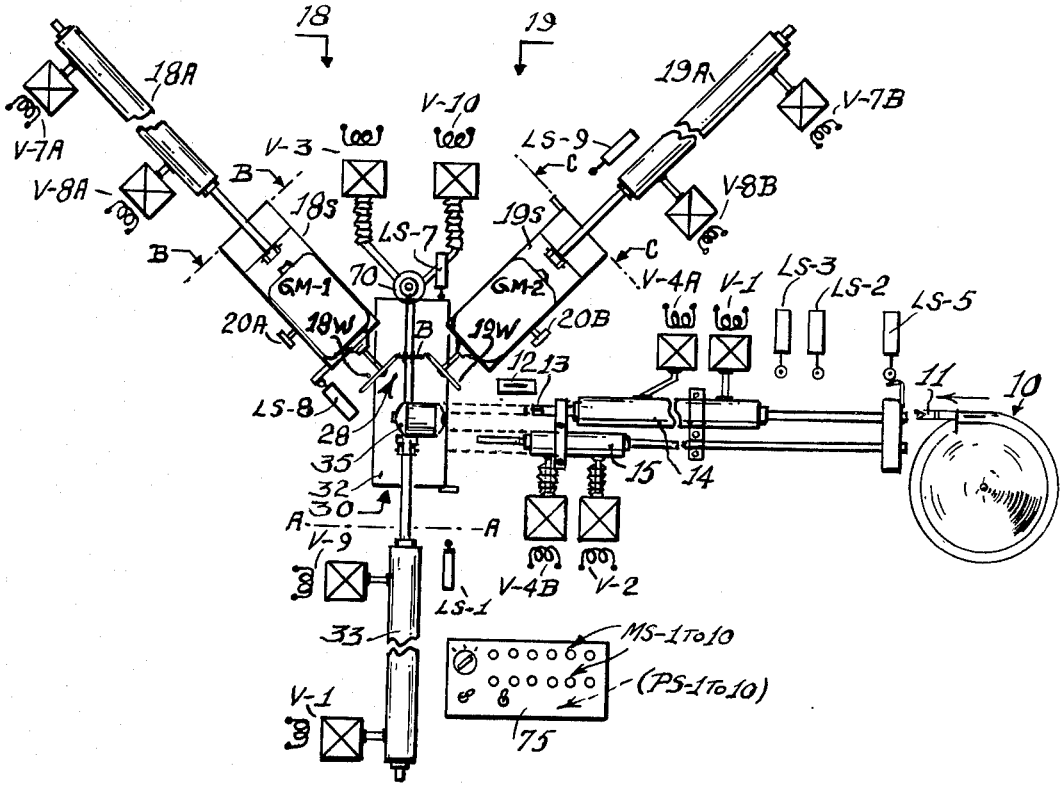
FIG. 1 is a schematic functional diagram illustrative of the cooperative arrangement of the working heads and loading means.

The diagrammatic placement of the machine components, as shown in FIG. 1, is referred to for illustration of the general sequence of operations thereof in accordance with which drill blanks —B— are fed serially from a hopper 10 along a downwardly inclined trackway 11 for deposit in a stacking magazine 12 to be picked up individually from the bottom thereof by a loading plunger 13 advanced by successively acting primary and secondary fluid-actuated drive cylinder means 14, 15, acting to insert the blanks into the collet of a rotary chuck 28 constituting part of a chuck or work head 30 supported on a transfer slide 32 reciprocable by cylinder 33 between a home starting position indicated by lines A—A and the working position at which it is shown in FIG. 1 confronting two grinding heads 18 and 19 thereat and including respective grinding wheels 18W, 19W and corresponding motors GM-1, GM-2 carried on respective slides 18S and 19S, which are likewise reciprocable between home positions B—B and C—C and the working position by corresponding slide cylinders 18A and 19A.

The aforesaid movements of the head slides, and the reciprocation of the loading plunger and opening and closing actions of the chuck 28 and plunger 13 are effected in duty cycles under control of limit switches actuated in home and advance positions of the slides and plunger, generally represented by reference characters prefixed "LS- . . . " in the structural views and in the circuit diagram and in cooperation with programme drum switch contacts generally designated by reference characters prefixed "PS- . . . ", constituting part of a control unit 75 operative to actuate forward and reverse valve solenoids for the several drive cylinders and designated by reference characters generally prefixed by the letter "V- . . . ", as will hereinafter more fully appear, whereby both ends of the drill blanks are formed simultaneously in a process in which they move unidirectionally through infeeding and outfeeding sides of the rotary chuck in either repetitious duty cycles without manual intervention, or in selected steps under control of manual over-ride switches generally designated by reference characters prefixed by the letters "MS . . . ", and useful particularly in set-up, adjustment, and general supervision.

Figure 2:
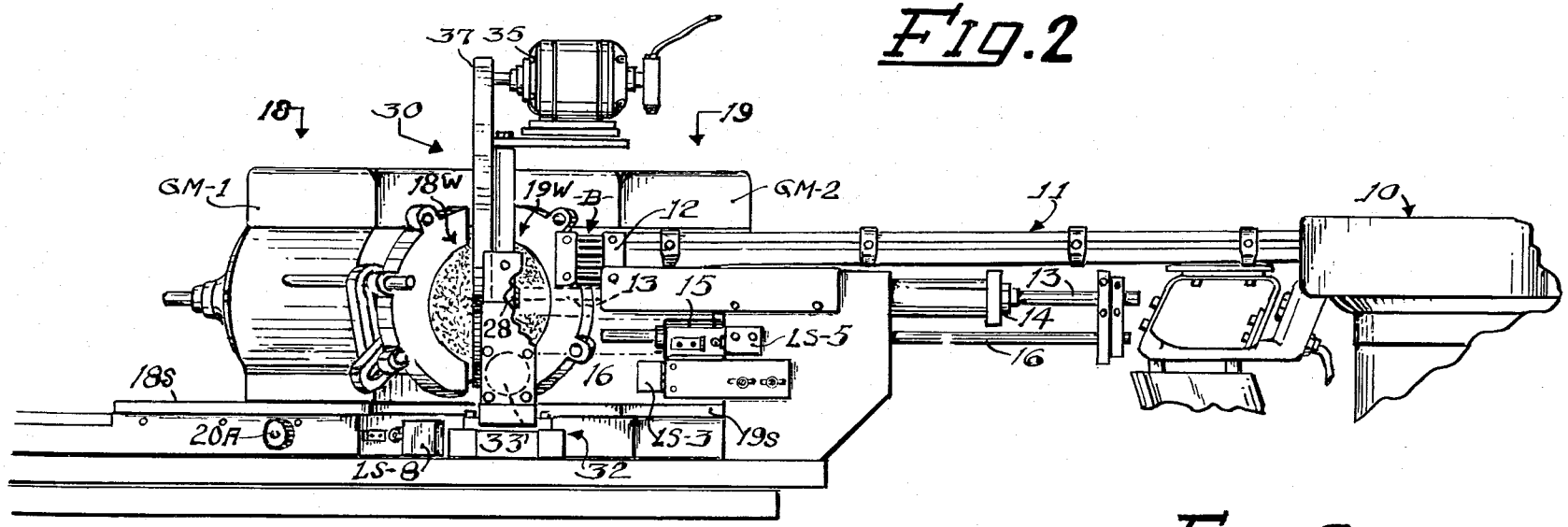
FIG. 2 is a side view of the machine with parts shown fragmentally.

In accordance with the construction of the machine as seen in FIG. 2, the blank-feeding means may be of the known type including vibratory-centrifugal parts-feeding mechanism (not seen) constituting part of the hopper 10 and operative to cause the cylindrical drill bodies or blanks —B— to move in serial alignment into and along the trackway 11 and into the upper part of the stacking magazine 12 for extraction from the bottom thereof one at a time upon each forward stroke of the loading plunger 13 at a time when the chuck 28 is standing open in home position with the bore of the collet disposed in axial alignment with the head of the loading plunger.

Figure 3:
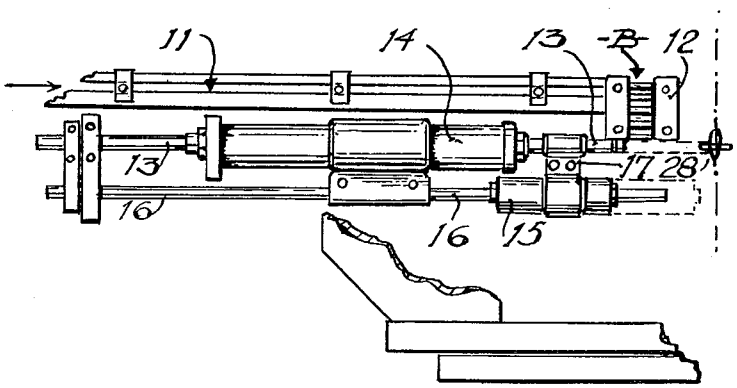
FIG. 3 is a fragmentary detail of the high-speed fluid-activated loading means viewed from the side of the machine which is opposite from that seen in FIG. 2.

Rapid blank loading is achieved by provision of the compound loading cylinder structure shown in FIG. 3 consisting of a large primary air cylinder 14, the plunger 13 of which has a blank-receiving formation at its end moving beneath the magazine exit toward the chuck collet in the home position of the transfer slide and chuck or work head to accept a blank and carry it rapidly to a threshhold position just short of entry into the collet in the initial air-driven power stroke of the primary cylinder, a forward loading limit switch LS-2 being thereby closed at this juncture to activate a smaller, oil-driven cylinder 15 clamped as a barnacle to the plunger 13, as seen in FIG. 3, and having its own plunger 16 fixed as at 17 so as to carry the primary plunger forward at a slower rate for the short remaining portion of the loading stroke to locate the blank accurately in the collet, and at the same time close its own forward limit switch LS-3 which, in conjunction with a programming switch means to be described, will thereafter effect closure of the collet to seize the blank prior to withdrawal of the loading plunger for return to home position.

The operations ensuing after the compound loading assembly is returned home by reverse valve operations, to be described, will include advance of the chuck transfer slide 32 by its cylinder 33 to lodge the chuck at the working position, together with the starting of the chuck motor 35; the forward movement of the two grinding heads 18 and 19 to working position, followed shortly thereafter by return of the same to home position; return of the transfer slide home, and finally opening of the chuck and stoppage of the chuck motor, thus terminating the automatic duty cycle, the finished blank being ejected by the blank which enters in the following cycle.

The grinding heads are of conventional construction, consisting respectively of slides 18S and 19S with corresponding driving motors GM-1, GM-2, grinding wheels 18W, 19W, and respective pre-settable micrometer feed controls 20A, 20B, which regulate the forward cutting advance of each slide by the respective air cylinders 18A, 19A, it being common that the cut for the prepointed end of the blank will be greater than the finishing chamfer applied to the opposite end, so that one of the grinding heads will commonly arrive at its limiting position before the other, in consequence of which only one forward limit switch LS-8 is used to serve both heads and be actuated by the one which travels farthest, as determined by the setting of the micrometer feeds 20A, 20B, actuation of which limit switch will cause return of both heads to home position.

Figure 4:
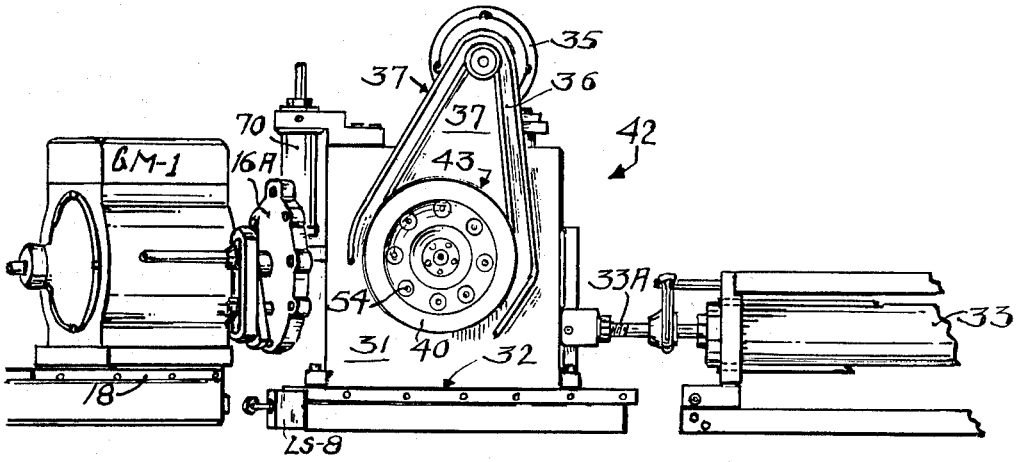
FIG. 4 is a front view of the chuck head with adjacent machine components shown fragmentally.
Figure 5:
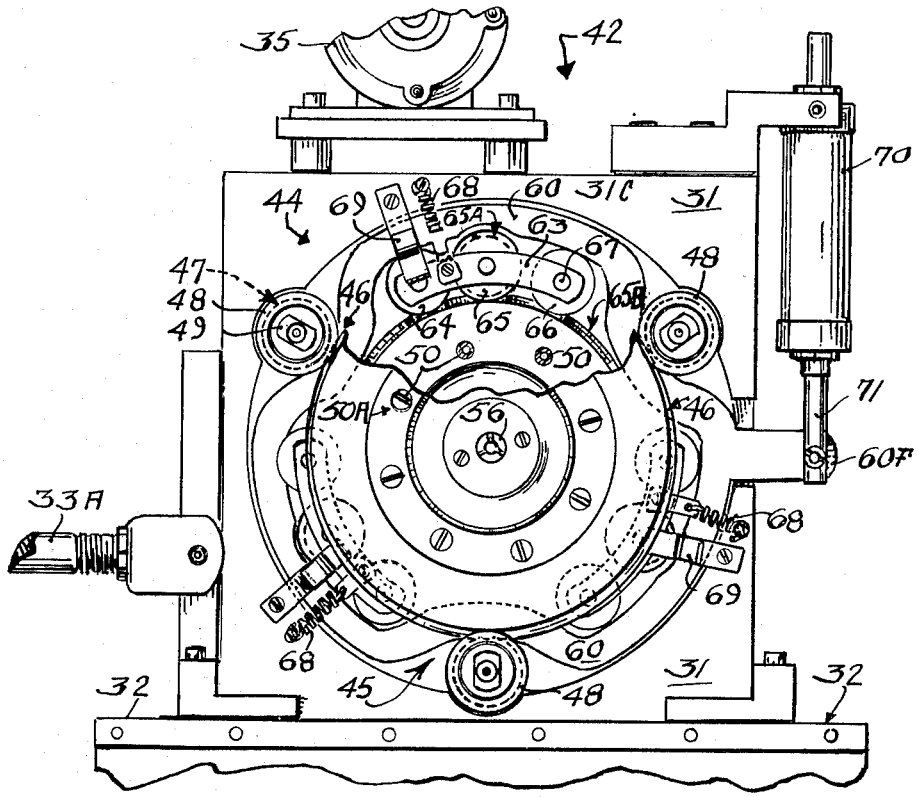
FIG. 5 depicts the chuck head to enlarged scale as viewed from the rearward or loading side opposite that seen in FIG. 4, parts being shown fragmentally.

As seen in FIG. 5, the chuck or work head and its special through-feeding collet structure and actuating mechanism, comprise a split rotary chuck assembly 42 of circular configuration peripherally journalled in an upright carrier plate 31 seated on the transfer slide 32 which is reversely shiftable by the ram 33A of its air cylinder 33. The view of FIG. 4 depicts the front or discharge side of the work head and the chuck, the latter including a pulley portion 40 driven from a small overhead motor 35 through belt means 36 running within a shield structure 37 fixed on the carrier with the motor, whereby the chucked cylindrical drill bodies will be rotated relative to the grinding wheels to chamfer both ends.

Figure 6:
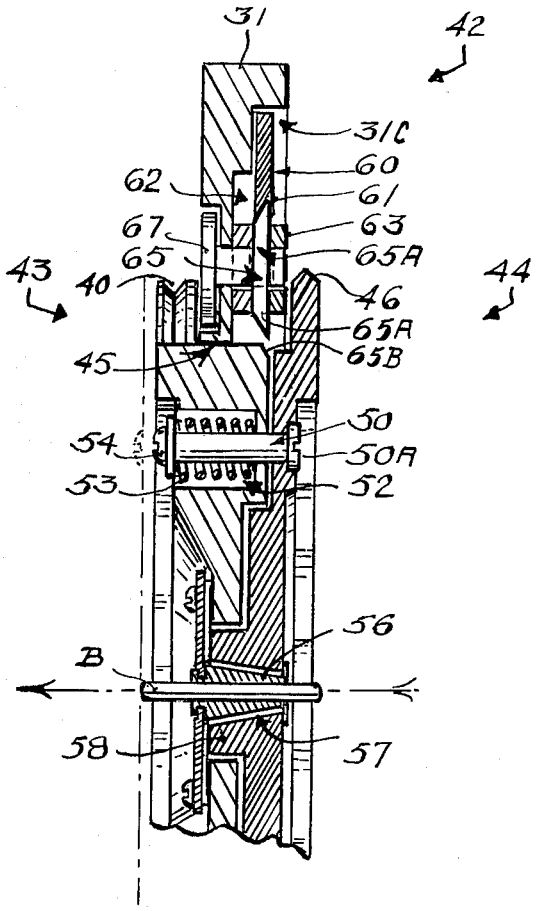
FIG. 6 is a partial cross-sectional detail of parts of the chuck assembly.

The split chuck assembly 42 consists of two relatively front and rear annular disc sections 43 and 44 rotatable in a large circular opening 45 through the carrier plate and having relatively slideable axial interfit as shown in the partial sectional detail of FIG. 6, the rear section 44 as seen in FIG. 5 having a bevelled knife-edge periphery 46 fitting into shallow tracking grooves 47 formed in the peripheries of a set of three circumferentially-spaced anti-friction bearings 48 each adjustably affixed to the carrier plate by eccentric spindle bolts 49 which can be turned to adjust and precisely set the respective bearings in supporting engagement with the knife-edge of the rear disc section by which means the entire chuck assembly is accurately centered and supported for free rotation by the small overhead motor 35.

The front chuck section is supported for axially-shifting displacement relative to the rearward journalled section by a circular array of studs 50 affixed to the inner face of the journalled disc by means such as the circularly set screws 50A, seen in FIG. 5, these studs projecting axially into corresponding spring wells 52 formed in a circle in the outer face of the shiftable front section 43, compression springs 53 being seated in each well and adjustably tensionable by retaining screws 54 threaded into the studs, whereby the front chuck section is urged into a normal position inwardly against the inner face of the journalled rear section, thereby forcing a conical collet 56 carried by the shiftable front section into a conical bore 57 formed in a hub portion 58 on the inner face of the rear section, with resultant clamping closure of the collet jaws, slight forward shifting of the front section being sufficient to permit the collet jaws to open by inherent opening bias thereof.

Figure 7:
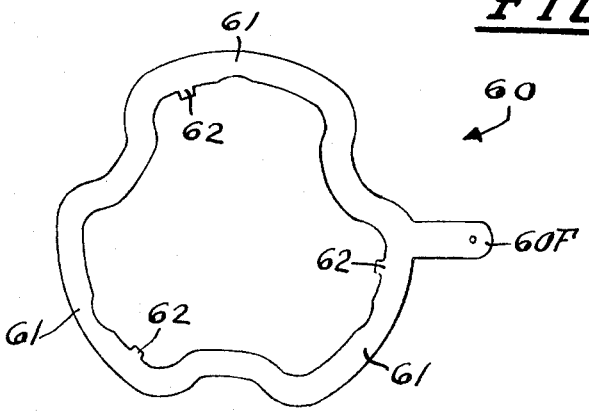
FIG. 7 is a plan detail of the chuck actuating ring cam.

Opening and closing of the chuck collet is effected by chuck-actuating mechanism fitted into a cavity 31C surrounding the large circular bore formed centrally in the upright carrier plate in which the chuck assembly rotates, said actuating means comprising a chuck-actuating ring cam 60, FIG. 5, seated at the bottom of said cavity and having the peculiarly trifoliate shape shown in FIG. 7 with three identical arcuate clearance configurations 61 each adapted to fit around a corresponding roller assembly 63 pivoted at 67 in deepened pocket portions of the cavity, each said clearance configuration including an inwardly projecting radial camming projection 62 adapted to engage one of the three rollers 64 in the appertaining rocker assembly to pivot the latter inwardly about its pivot stud 67 against the tension of a corresponding return spring 68, each rocker assembly being pressed into its seat by a retaining blade spring 69, as seen in FIG. 5.

The rocker assemblies each include three rollers 64, 65, and 66, roller 66 constituting an idler which rotates about the pivot stud 67 and rides on a rim portion of the rear chuck disc as a stabilizing and locating stop means, while the second and central roller 65 is a wedging roller having a bevelled edge 65A adapted to bear against a peripheral margin of the rear disc section, as indicated at 65B in FIG. 6, the third roller 64 at the free end of the rockers being a camming roller of smaller diameter engaged by a corresponding one of the camming projections 62 on the cam ring responsive to counterclockwise shifting of the latter, whereby the rockers pivot jointly to force their respective wedging rollers against the shiftable front chuck section and displace the latter to open the chuck collet in the manner explained, the smaller end rollers 64 also serving to limit the throw of the rocker assemblies by the cam ring by their engagement with rim portions of the rear chuck disc, while roller 66 serves as a stop for the ring.

The major portion of the chuck-actuating mechanism comprising the rocker assemblies and ring cam fit substantially entirely within the cavity of the carrier plate and are operative whether the chuck is rotating or at rest, the cam ring being shifted in either case by the chuck-operating cylinder 70 which travels with the chuck head, plunger 71 connecting to the radially-extending operating finger 60F projecting from the cam ring.

MANUAL AND PROGRAMMED CIRCUIT CONTROL

Figure 8:
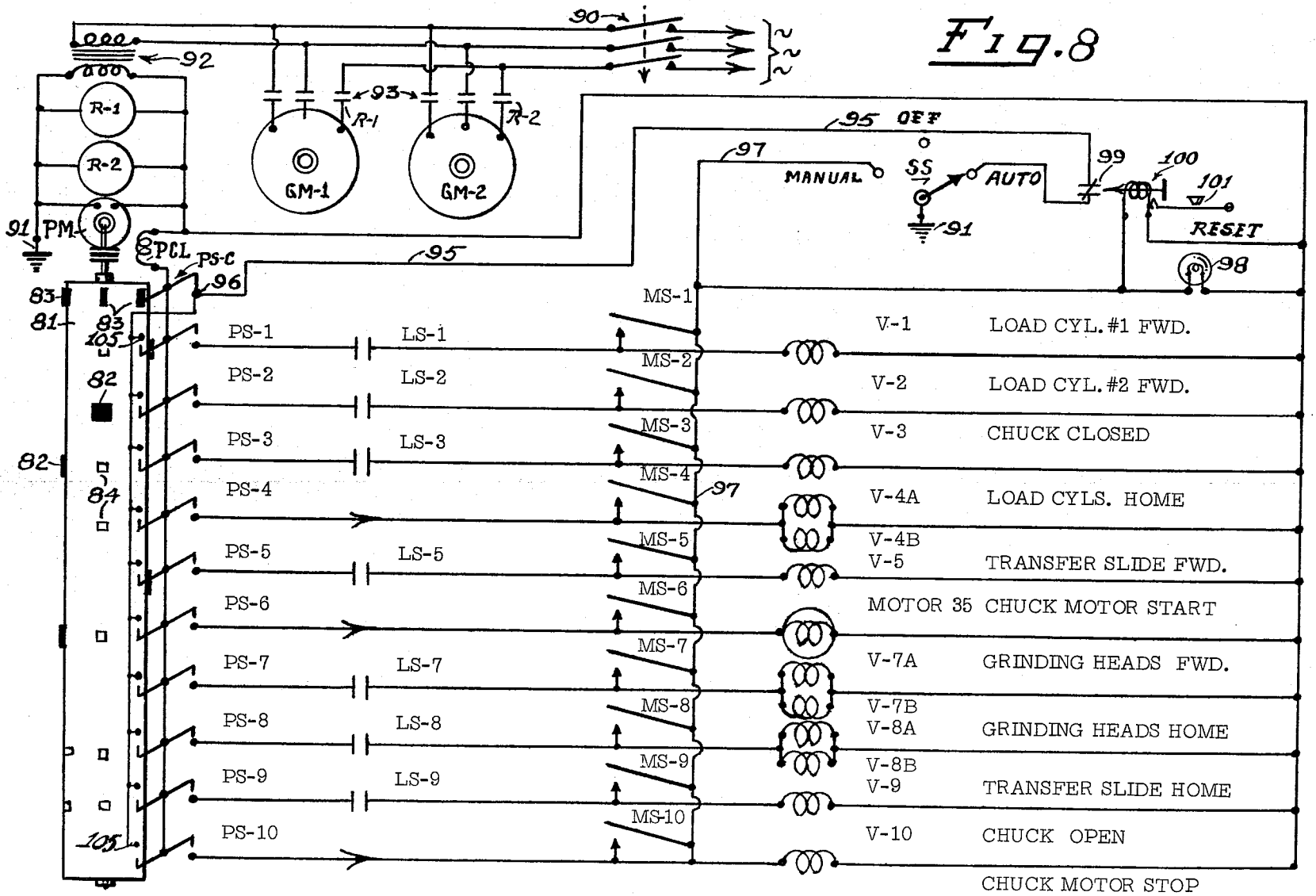
FIG. 8 is a diagram of the program control circuitry.

In accordance with the form of control circuitry presented in FIG. 8, the machine and control components are conditioned for operation in either the automatic or manual mode by setting the selector switch SS and closing the master power switch 90, the latter resulting in energization of a transformer 92 actuating the two relays R-1, R-2, which close contacts 93 to start the grinding motors GM-1, GM-2, together with energization of the program switch drum motor PM which will rotate the program drum 81 slowly through an electromagnetic clutch PCL. In general, the program switches such as PS-1, PS-10, etc., govern the automatic duty cycle, whereas manual step-by-step operation is governed by a set of manual switches MS-1 . . . MS-10.

If the selector switch is set on "Manual" the power ground 91 is connected to bus conductor 97 feeding all of the manual switches, closure of any of which completes a power circuit directly to the corresponding forward or reverse pneumatic valve, such as V-1, V-2, etc., or the chuck motor 35, and by-passes the programme switches and limit switches.

Thus, for example, the primary loading cylinder may be manually activated to send the plunger forward to the threshold position by closure of manual switch MS-1, thus energizing the appertaining valve solenoid V-1 directly to produce the function designated as "Load Cyl.#1 Forward" and so-on through the several machine cycle functions as designated in FIG. 8.

Whenever the manual setting is employed and power is applied to the manual switch bus conductor 97 a warning light 98 is illuminated informing the operator that the machine may be off-cycle or standing in the manual mode, and to compel attention to this signal the normally closed contacts 99 on a lockout relay 100 are opened to disable the "Auto" setting and program clutch coil circuit until the lockout relay is manually reset by button 101.

PROGRAMMED OPERATION

With the selector switch SS set in the "Auto" position, power is applied at contact 96 for the programme drum clutch switch PS-C, actuating this clutch and rotating the drum 81, this switch being of known type wherein a multitude of plug-seating apertures 84 are arranged coordinately in axially extending rows and circumferentially extending columns to receive switch-actuating cam plugs, the plugs 83 in the first column being clutch control plugs actuating a microswitch PS-C, while the remaining plugs 82 actuate the various remaining function switches in accordance with their setting about the drum.

Whenever the clutch is energized by one of the clutch plugs 83 the drum will rotate one step of approximately 15° and stop unless there is a program plug 82 in position to hold the clutch circuit via one of the program switch carry-over contacts 105 acting to hold the clutch in for another step so that there is substantially no hesitation in the successive drum movements in advancing through the duty cycle.

In the condition shown in FIG. 8, application of power by closure of master switch 90 with the selector switch in "Auto" position, as aforesaid, will start the programme drum automatically via PS-C, and Contact 96 such that the several machine programme switches starting with PS-1 will then close in accordance with the disposition of the various switch-actuating plugs 82.

For example, PS-1 closed will energize the forward solenoid V-1 for the primary loading plunger via limit switch LS-1 closed by the Chuck Head Transfer Slide 32 in its home position, and thereby send the plunger forward to its threshhold position with resultant closure of limit switch LS-2, which will then trigger valve V-2 responsive to closure of PS-2, thereby sending the secondary loading cylinder forward to complete loading of the part into the chuck collet while at the same time closing this plunger's forward limit switch LS-3 in readiness to actuate the chuck cylinder valve V-3 and close the chuck responsive to the next following drum switch signal from PS-3.

With the chuck closed as aforesaid, the following programme signal from PS-4 will directly and simultaneously energize both of the plunger valve homing solenoids V-4A and V-4B, thereby returning the two loading plungers home with consequent closure of their common homing limit switch LS-5, so that the next drum signal from PS-5 will actuate the forward transfer slide valve V-5 and send the slide forward to working position by activation of cylinder 33, with consequent closure of the slide's forward limit switch LS-7.

While the slide is moving forward, drum switch PS-6 will be closing to start the chuck motor 35 so that on the following signal from PS-7 via the forward slide limit switch LS-7, when closed, the two grinding heads will advance in unison to working position and begin the grinding operation under control of their respective micrometer feed controls 20A, 20B, which for pre-pointing and chamfering purposes is very brief.

The pre-pointing cut at the leading end of the blank may be slightly greater than the finish chamfer applied to the opposite end thereof, in which case one of the two grinding heads will stop before the other, and the forward limit switch LS-8, serving these heads, will therefore be set to be actuated by the slide which is to travel the greater distance, thereby causing actuation of the head reversing valves V-8A and V-8B, to return the two heads to home position with resultant closure of their common home limit switch LS-9.

As the terminal phase in the duty cycle, PS-9 will trigger return of the transfer slide via LS-9 with reclosure of its home limit switch LS-1 in readiness for the next cycle, the chuck being opened by the last of the indicated programme switch functions with closure of PS-10 activating the reverse chuck cylinder valve V-10, the program switch PS-6 meanwhile having remained closed up to this point (e.g., by use of four successive switch plugs) to keep the chuck motor running throughout the grinding operation, the stoppage of this motor marking the end of the duty cycle, with the clutch programme switch PS-C again standing closed with contact 96 in readiness to repeat the cycle in the automatic mode.

I claim:

1. In a grinding machine operative to grind substantially simultaneously both ends of workpieces such as drill bodies, first and second individually shiftable grinding heads each including a corresponding grinding wheel movable to and from respective starting positions and a working position; presettable means operative to limit the forward grinding movement of said grinding heads in the direction of said working position; a workhead carried on a transfer table shiftable from a starting position to said working position and including a rotary through-bore chuck operative to seize a workpiece with opposite ends thereof exposed in space for engagement respective with one of said wheels at said working position responsive to advance of the wheels in forward movement of the grinding heads relative thereto; drive means operative in timed action to move the heads from their starting positions to the working position in timed relation with advance of the wheels against corresponding ends of the workpiece to respectively preset limits under control of said presettable means and thereafter effect reverse movement of the heads in return to starting position and opening of the chuck as an incident to return of the workhead to such starting position; together with loading means operative in timed relation to movement of the workhead back to starting position to transfer a workpiece from a source of supply into said chuck.

2. Apparatus according to claim 1 further characterized by the provision of a motor travelling with said work head and operative to rotate said chuck in any of its shift positions.

3. Apparatus according to claim 1 wherein the chuck is opened and closed by reversely operative fluid-activated means travelling with said work head.

4. Apparatus according to claim 1 wherein said chuck comprises front and rear split sections one of which is rotatively journalled solely at its periphery on a carrier member comprising part of said work head, and supports the other section for joint rotation therewith and axially shifting displacement relative thereto, the shiftable section being spring urged into a normal proximity relative to the journalled section, one of said sections carrying a collet with a through-bore operative in opening and closing action dependently upon its proximity to the other section, and control means operative to displace the shiftable section axially to and from said normal proximity position to open and close the chuck collet.

5. The construction of claim 4 further characterized in that said control means comprises a ring cam circumambient of said chuck assembly and means include wedging rollers movable by said cam to and from wedging engagement with one of said sections to cause collet actuating movement of the shiftable section relative to said normal proximity position.

6. The construction of claim 5 further characterized in that said ring cam and wedging rollers are supported on a carrier plate on which the peripherally journalled chuck section is supported, together with ring-actuating means comprising a fluid-activated reversely operating drive means travelling with said chuck head and operative to shift the ring cam angularly to cause opening and closing of the collet.

7. Apparatus according to claim 6 further characterized in that said wedging rollers comprise part of an assembly of rockable rollers pivotally mounted on said carrier plate circumambiently about said journalled chuck section, each said assembly including one of said wedging rollers and a camming roller engaged by a part of the ring cam responsive to angular movement thereof from a normal position whereby to rock the wedging rollers and cause operative engagement of said wedging rollers with the shiftable chuck section and actuate the collet as aforesaid responsive to activation of said fluid-activated means.

8. A grinding machine according to claim 1 wherein said loading means comprises fluid-operated cylinder means reversely driving a loading plunger in an initially rapid advancing stroke to transport a drill blank from a magazine to a threshhold position just short of entry into the chuck collet, with continuing advance at a slowed rate for the remaining distance necessary to enter the blank into the chuck in a predetermined precise location to expose the ends of the blank from the chuck for the purpose aforesaid.

9. The grinding machine of claim 1 further including programmed control means comprising a motor-rotated programming member, program switches actuated in a predetermined programme sequence by said programming member; limit switch means actuated by machine components in a predetermined sequence; fluid valve means activated and de-activated by certain of said programme switches and limit switches; and circuit means connecting said switches for operation in duty cycles in which said fluid-activated drive means shifts said chuck head and said grinding heads from said starting to said working positions with return of the heads to starting position in each duty cycle, and activation of said loading means in each cycle while the chuck head stands in starting position.

10. Apparatus according to claim 9 further characterized in that said control means includes manually operable override switch means connected and selectively operable to actuate the instrumentalities controlled by said programme switches.

11. A grinding machine operative to grind simultaneously both ends of a workpiece such as drill bodies and including individually shiftable grinding heads with corresponding grinding wheels cooperatively disposed relative to a shiftable workhead carrying a through-feeding rotary chuck; means operative to open and close the chuck; actuating means including fluid-displacement drive means operative to shift the respective heads reversely to and from their respective starting positions and a working position at which the chuck exposes each of the ends of the chucked workpiece to engagement substantially simultaneously with a corresponding one of said wheels; loading means operative to effect delivery of work pieces from a magazine into the chuck in open condition at the starting position of the workhead; together with control means operative in duty cycles to open the chuck at starting position of the work head, actuate said loading means to load a work piece therein with ends exposed as aforesaid, close the chuck, actuate said drive means to send the heads forward to said working position for grinding engagement of the ends of the work piece with corresponding wheels by continued advance thereof relative to the work piece, said grinding heads including presettable limit means operative to limit advance thereof as aforesaid; and means responsive to said limit means operative to return the heads to starting position and open the chuck in termination of the duty cycle.

12. A grinding machine according to claim 11 further characterized in that the chuck comprises a carrier support and a pair of coaxial disc members the first one of which is journalled at its periphery on the support and the other of which is shiftable axially toward and from the first and normally spring-urged toward the latter to a chuck-closing condition; a chuck collet carried by one of the drive members is normally biased open and closed by the closing condition of the discs; together with wedging means carried by the support and operative to effect axial displacement of the shiftable disc member to open the chuck collet.

13. Apparatus according to claim 12 wherein the wedging means includes a wedge roller rockably mounted on the carrier and forcibly movable against one of the disc members to effect said displacement.

14. Apparatus according to claim 13 wherein there are three of said wedge rollers respectively spaced about the periphery of the shiftable disc member and actuating means is provided for forcibly shifting the rollers simultaneously as aforesaid including an actuating cam in the form of a ring mounted coaxially of the shiftable disc member on the carrier and having camming means operative responsive to angular shifting of the ring to force the wedging rollers against the shiftable disc member for the purpose aforesaid.

15. Apparatus according to claim 14 further characterized by the provision of a radial projection from said actuating ring cam and reverse-acting hydraulic cylinder means mounted on said carrier and connecting with said projection for operation to effect reverse angular shifting of the cam ring to effect opening and closing action of the chuck collet.

16. The method of prepointing cylindrical drill bodies which comprises supporting the body rotatively on a shiftable work head with opposite ends thereof exposed for grinding engagement with corresponding grinding wheels, rotating said body while moving the work head from a starting position into a predetermined working position and concurrently moving said grinding wheels from respective starting positions forwardly into grinding engagement each with one of the exposed end regions of the drill body and continuing said forward movement of the wheels to preset limiting positions at which the forward grinding movement thereof is stopped and automatically reversed in timed relation to reverse shifting of the work head back to starting position and stoppage of rotation of the drill body, the rotation of the drill body and movements of the work head and wheels to and from said working position being effected in a predetermined timed relationship.

* * * * *